US008708732B2

(12) United States Patent
Toda et al.

(10) Patent No.: US 8,708,732 B2
(45) Date of Patent: Apr. 29, 2014

(54) CONNECTOR HAVING A RECEPTACLE AND A PLUG WITH A PAIR OF LOCKING PIECES WITH A PAIR OF LOCKING HOOKS

(71) Applicant: Japan Aviation Electronics Industry, Limited, Tokyo (JP)

(72) Inventors: Takeo Toda, Tokyo (JP); Hideto Shimazu, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/648,261

(22) Filed: Oct. 9, 2012

(65) Prior Publication Data

US 2013/0109243 A1 May 2, 2013

(30) Foreign Application Priority Data

Oct. 28, 2011 (JP) ..... 2011-236859

(51) Int. Cl.
*H01R 13/627* (2006.01)

(52) U.S. Cl.
CPC ..... *H01R 13/6273* (2013.01)
USPC ..... 439/352

(58) Field of Classification Search
CPC ..... H01R 13/6273; H01R 13/6275; H01R 13/6272
See application file for complete search history.

(56) References Cited

U.S. PATENT DOCUMENTS

| | | | | |
|---|---|---|---|---|
| 5,316,494 | A * | 5/1994 | Flanagan et al. | 439/352 |
| 6,702,602 | B2 * | 3/2004 | Wu | 439/352 |
| 7,264,402 | B2 * | 9/2007 | Theuerkorn et al. | 385/59 |
| 7,503,788 | B2 * | 3/2009 | Holterhoff et al. | 439/256 |
| 7,892,004 | B2 * | 2/2011 | Hertzler et al. | 439/312 |
| 8,475,200 | B2 * | 7/2013 | Greub et al. | 439/359 |
| 2002/0127919 | A1 * | 9/2002 | Wang | 439/682 |
| 2004/0023545 | A1 * | 2/2004 | Wu | 439/352 |
| 2009/0305542 | A1 | 12/2009 | Masuzaki | |
| 2011/0003501 | A1 | 1/2011 | Greub et al. | |

FOREIGN PATENT DOCUMENTS

| | | |
|---|---|---|
| JP | 2009-509205 | 3/2009 |
| JP | 2009-294343 | 12/2009 |
| WO | 2007/037990 | 4/2007 |

OTHER PUBLICATIONS

Korea Office action, dated Sep. 17, 2013 along with an english translation thereof.

* cited by examiner

*Primary Examiner* — Chandrika Prasad

(74) *Attorney, Agent, or Firm* — Greenblum & Bernstein, P.L.C.

(57) ABSTRACT

Connector includes a plug and receptacle. The receptacle includes a cylindrical part and a flange. The plug includes a cylindrical barrel, which houses internal connectors, and a coupling nut. At an end of the barrel, an engaging piece and a pair of locking pieces, which face each other, project in an axial direction of the barrel. Locking hooks are formed at the tips of the locking pieces. The coupling nut is screwed onto the cylindrical part to connect the plug to the receptacle. Before the connection, the engaging piece and the locking pieces are inserted into and engaged with the cylindrical part and positioned. At the same time, the locking pieces are caught in the receptacle to temporarily secure the plug to the receptacle.

10 Claims, 9 Drawing Sheets

CONNECTOR HAVING A RECEPTACLE AND A PLUG WITH A PAIR OF LOCKING PIECES WITH A PAIR OF LOCKING HOOKS

TECHNICAL FIELD

The present invention relates to a connector including a plug and a receptacle and, more particularly, to a connector that houses a pair of internal connectors such as optical connectors that are connected to each other, and forms outer shells to protect the internal connectors.

BACKGROUND ART

FIGS. 11A and 11B show the structure of the connector disclosed in patent literature 1 (U.S. Patent Application Publication No. 2011/0003501). The reference numeral 11 in FIGS. 11A and 11B denotes an optical connector attached to an end of an optical fiber and the reference numeral 12 denotes a mating optical connector into which the optical connector 11 is inserted. The reference numeral 13 denotes a plug that houses the optical connector 11. The reference numeral 14 denotes a receptacle that houses the optical connector 12. The plug 13 and the receptacle 14 form outer shells of the optical connectors 11 and 12, respectively. In FIGS. 11A, 11B, the reference numeral 15 denotes an optical cable and the reference numeral 16 denotes a transceiver to which the optical connector 12 is connected.

The receptacle 14 includes a cylindrical part 17 and a flange 18 formed at one end of the cylindrical part 17. Threads are formed in an outer circumference of the cylindrical part 17 and two depressions 19 are formed in an inner surface of the cylindrical part 17.

The plug 13 includes a cylindrical body 21 and an external cylinder 22, which is placed external to the cylindrical body 21. Two boom-like arms 23 project from the cylindrical body 21. A locking part 24 is provided at an end of each of the arms 23.

The plug 13 and the receptacle 14 are connected to each other when threads formed in an inner surface of the end portion of the external cylinder 22 for the plug 13 are screwed onto the thread of the cylindrical part 17 of the receptacle 14 in the state in which the locking parts 24 at the ends of the two arms 23 of the plug 13 are inserted into and caught in the depressions 19 in the cylindrical part 17 (the state in which they are temporarily retained).

SUMMARY OF THE INVENTION

In the above structure including the plug 13 and the receptacle 14, when the locking parts 24 at the ends of the arms 23 of the plug 13 are caught in the receptacle 14, the arms 23 of the plug 13 can be retained to the receptacle 14 (that is, the plug 13 can be temporarily retained to the receptacle 14), thereby facilitating the connection of the optical connectors 11 and 12. Even when, for example, the receptacle 14 is attached to the ceiling of a room and the plug 13 is connected to the receptacle 14 in a vertically upward direction, it is possible to prevent the optical connector 11 from being detached (falling) during insertion and connection of the optical connector 11 or screwing of the external cylinder 22.

A problem with the plug 13 shown in FIGS. 11A and 11B is that the locking parts 24 are likely to be disconnected from the receptacle 14 when an external force is applied in the upward/downward direction (Z-direction), which is orthogonal to the left/right direction (Y-direction) in which the locking parts 24 face each other, because only two locking parts 24 that face each other in the cylindrical part 17 are used, the locking parts 24 are only shaped to be caught in the receptacle 14, and the arms 23 are too long to achieve a sufficient locking strength.

The present invention addresses the above problem with the object of providing a connector that has an improved locking strength during temporary fixation as compared with the prior art by temporarily securing the plug to the receptacle tightly before connecting the plug to the receptacle through screwing.

A connector according to the present invention comprises a plug capable of housing, as an outer shell, one internal connector and a receptacle capable of housing, as an outer shell, another internal connector, the plug and the receptacle being connected to each other, the one internal connector and the other internal connector being connected to each other, wherein the receptacle includes a cylindrical part and a flange formed at one end of the cylindrical part, the plug includes a cylindrical barrel that houses the one internal connector and a coupling nut that is disposed on an outer circumference of the barrel and movable along an axial direction of the barrel, an engaging piece and a pair of locking pieces project in the axial direction from an end of the barrel, the pair of locking pieces facing each other in a diametric direction of the barrel, and a pair of locking hooks project outwardly from each other from the respective tips of the pair of locking pieces, the engaging piece and the pair of locking pieces being inserted into and engaged with the cylindrical part by the pair of locking hooks so as to be positioned on an inner surface of the cylindrical part, the pair of locking pieces being secured to the receptacle by the pair of locking hooks so that the plug is temporarily secured to the receptacle, and the plug and receptacle are connected to each other when the coupling nut is screwed onto threads formed on an outer circumference of the cylindrical part.

According to the present invention, the plug can be temporarily secured to the receptacle tightly before the plug is screwed onto and connected to the receptacle. This sufficiently prevents the plug from being disconnected (falling) by an unexpected external force even when, for example, the plug is connected to the receptacle in a vertically upward direction, thereby making the connection of the internal connectors and the screwing of the plug easy and safe.

DETAILED DESCRIPTION OF THE EMBODIMENTS

An embodiment of the present invention will be described with reference to the drawings.

Figure 1:
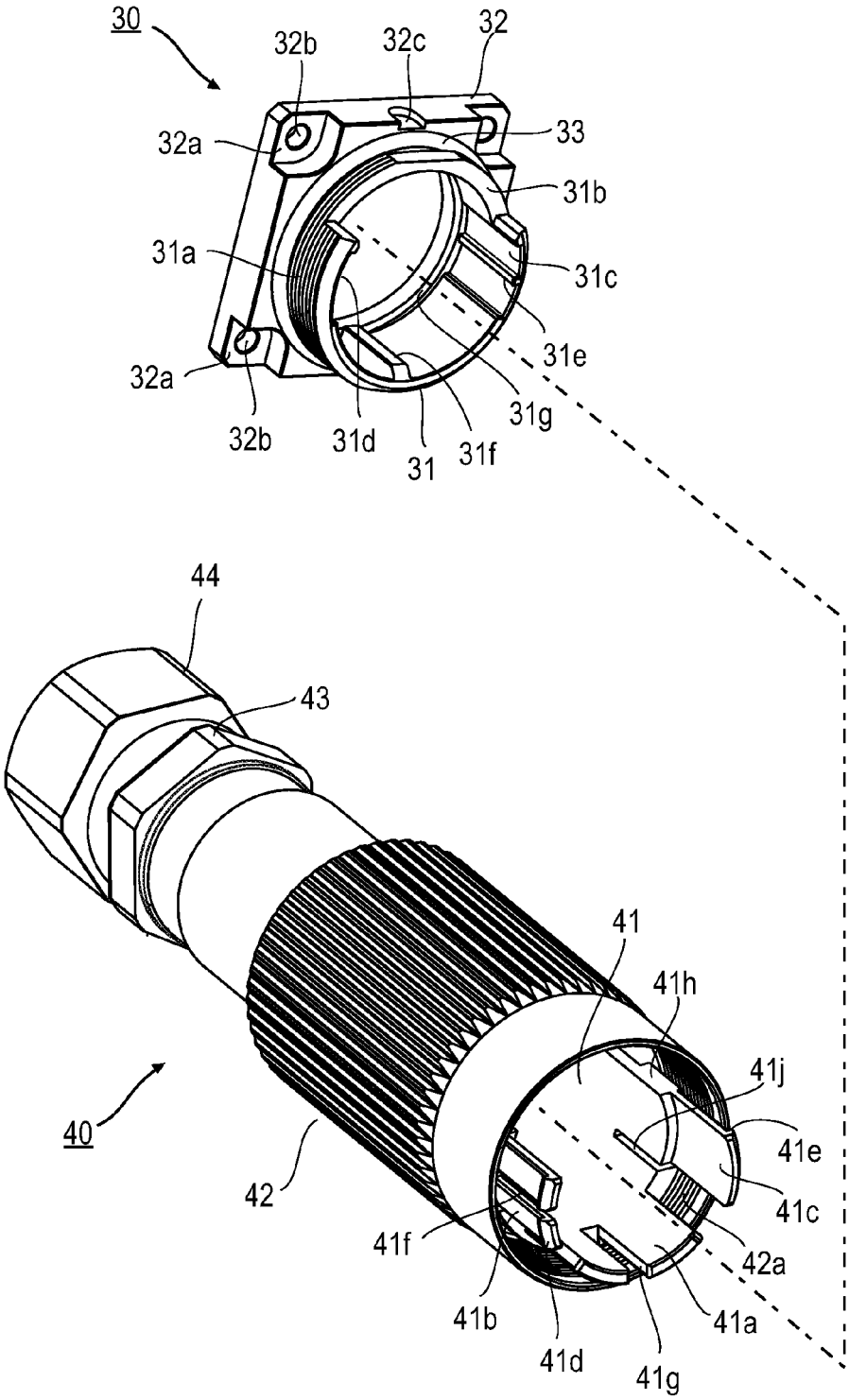
FIG. 1 is a perspective view illustrating a receptacle 30 and a plug 40 of a connector according to an embodiment of the present invention.
Figure 2:
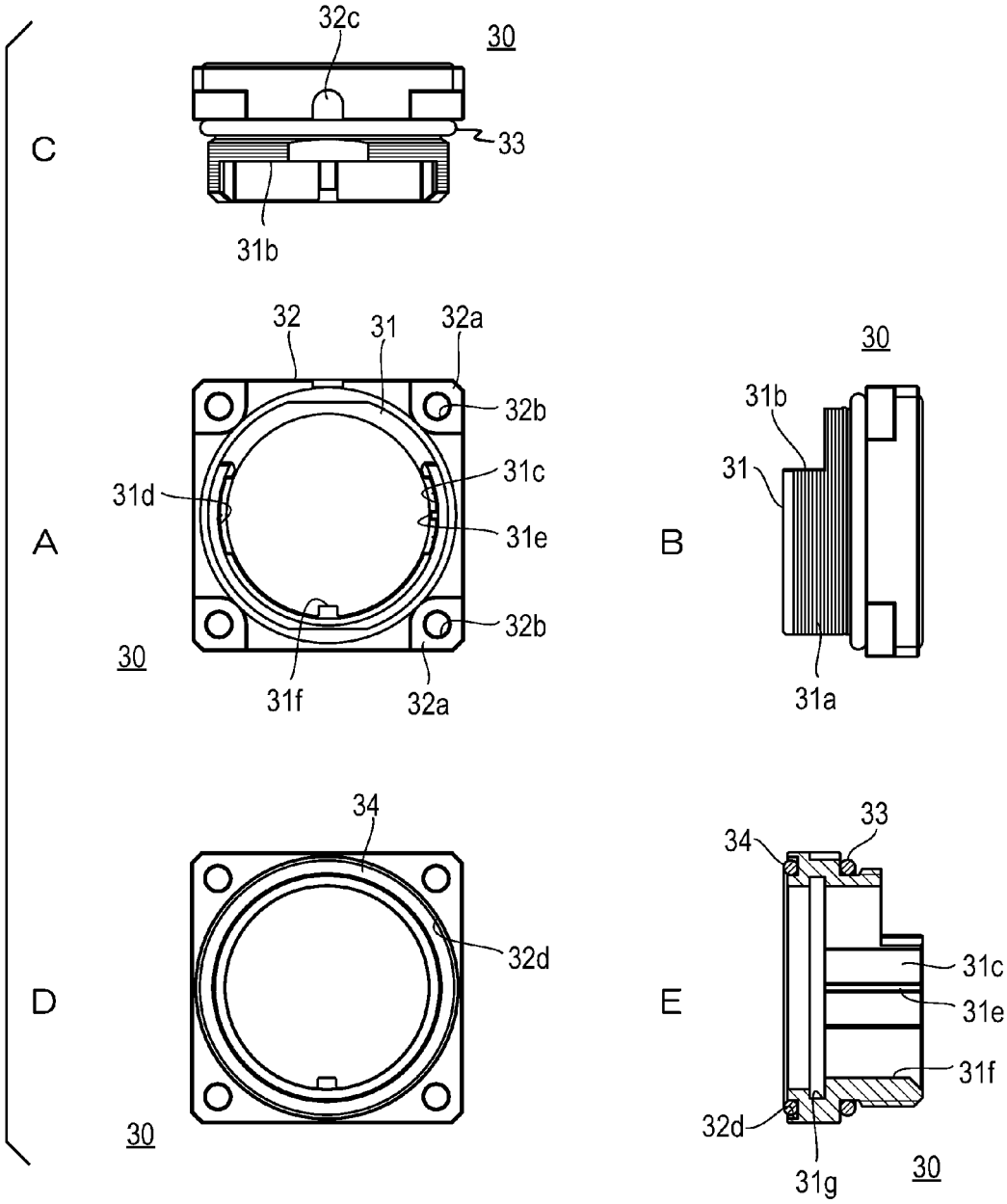
FIG. 2 illustrates a front elevational view (A), a side view (B), a plan view (C), a rear elevational view (D), and a sectional view (E) each of the receptacle 30 in FIG. 1.
Figure 3A:
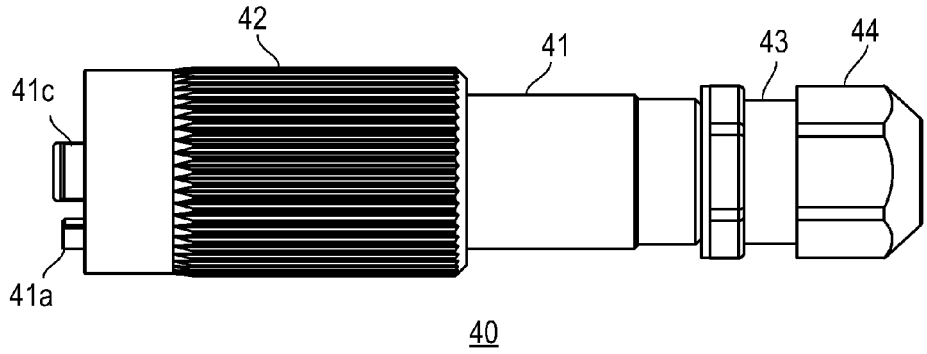
FIG. 3A is a side view of the plug 40 in FIG. 1.
Figure 3B:
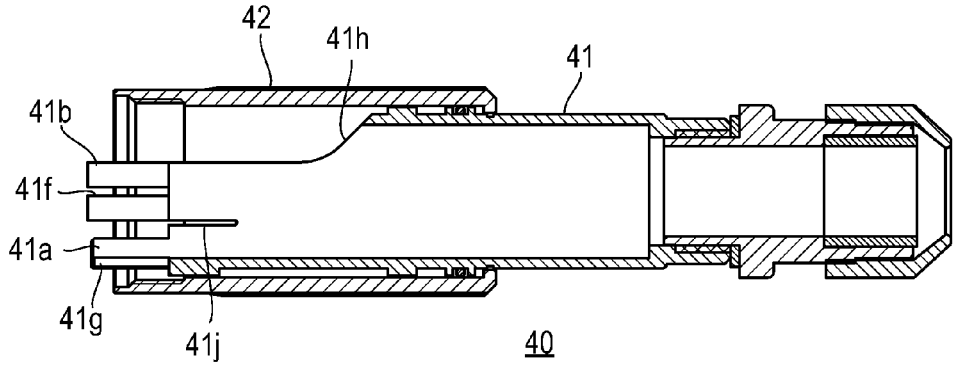
FIG. 3B is a vertical sectional view of a section including the axis of the plug 40 in FIG. 1.
Figure 3C:
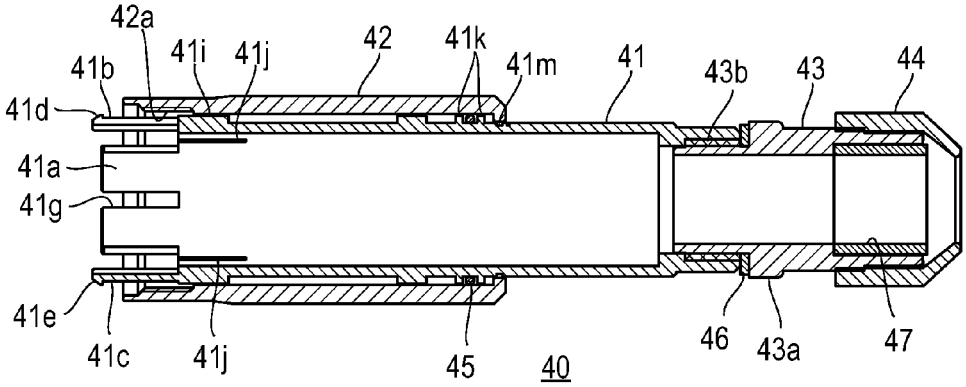
FIG. 3C is a horizontal sectional view of a section including the axis of the plug 40 in FIG. 1.

FIG. 1 shows the appearance of a receptacle 30 and a plug 40 of a connector according to the present invention; FIG. 1 does not show internal connectors to be housed in the receptacle 30 and the plug 40. FIGS. 2A to 2E show the shape of the receptacle 30; FIGS. 3A to 3C show the shape and sectional structure of the plug 40.

The receptacle 30 made of metal includes a cylindrical part 31 and a flange 32 formed at one end (rear end) of the cylindrical part 31. Threads 31*a* are formed in the outer circumference of the cylindrical part 31. A wide arc-shaped cutout 31*b* is formed in the front end side portion of the cylindrical part 31 and the cutout 31*b* provides a large opening in an upper portion of the front end side portion of the cylindrical part 31.

In an inner surface of the cylindrical part 31, a pair of recessed sections 31*c* and 31*d* are formed to extend in an axial direction thereof and face each other. A key 31*e* projects toward the central axis of the cylindrical part 31 from the recessed section 31*c* so as to halve the recessed section 31*c* in the circumferential direction of the cylindrical part 31. In addition, a key 31*f* projects from a portion, facing the cutout 31*b*, of the inner surface of the cylindrical part 31 toward the central axis.

The pair of recessed sections 31*c* and 31*d* and the pair of keys 31*e* and 31*f* extend from the front end of the cylindrical part 31 by a certain length. The rear ends of the recessed sections 31*c* and 31*d* and the keys 31*e* and 31*f* are followed by an annular groove 31*g* formed in the inner surface of the cylindrical part 31.

The flange 32 is square-shaped, a counter-bored section 32*a* is formed in each of the four corners of the flange 32, and a through hole 32*b* is formed in the counter-bored section 32*a*. A marker 32*c* is formed in one of the four sides of the flange 32 corresponding to the position of the cutout 31*b* of the cylindrical part 31. The marker 32*c* in this example is a shallow concave portion with a shape as shown in FIGS. 1 and 2C.

The receptacle 30 is secured to, for example, a panel etc. by screwing the flange 32. A screw is inserted into each of the four through holes 32*b* and screwed into the panel. At this time, the head of each screw rests in the corresponding counter-bored section 32*a*.

O-rings 33 and 34 (see FIG. 2E) are placed in the receptacle 30. The O-ring 33 is placed in the root of the cylindrical part 31 and the O-ring 34 is placed in a circular groove 32*d*, concentric with the cylindrical part 31, that is formed in the rear face of the flange 32. The O-ring 34 is sandwiched between the panel and the flange 32 when the flange 32 is secured to the panel etc.

As shown in FIGS. 3A, 3B, and 3C, the plug 40 in this example includes a barrel 41, a coupling nut 42, a clamp body 43, a clamp nut 44, an O-ring 45, a barrel packing 46, and a cable seal 47. The barrel 41, the clamp body 43, and the clamp nut 44 are made of resin and the coupling nut 42 is made of metal.

The barrel 41 is cylindrical and an engaging piece 41*a* and a pair of locking pieces 41*b* and 41*c* (see FIGS. 1 and 3C) project in the axial direction from an end of the barrel 41. The pair of locking pieces 41*b* and 41*c* are formed so as to face each other in a diametric direction of the barrel 41 and a pair of locking hooks 41*d* and 41*e* projecting outwardly from each other are formed at the tips of the pair of locking pieces 41*b* and 41*c*. A slit 41*f* extending in the axial direction is formed in the locking piece 41*b* so as to halve the locking piece 41*b*.

The engaging piece 41*a* is wider than the locking pieces 41*b* and 41*c*, and therefore takes up a larger part in the circumference of the barrel 41. A slit 41*g* is formed in the engaging piece 41*a* in the axial direction.

A wide cutout 41*h* is formed in an end portion of the barrel 41 and the cutout 41*h* provides a large opening in an upper portion of the end portion of the barrel 41. The cutout 41*h* extends from the end of the barrel 41 to substantially the middle of the barrel 41 in the axial direction. In this example, the cutout 41*h* is formed in the circumferential direction of the barrel 41 between the pair of locking pieces 41*b* and 41*c* on a side on which the engaging piece 41*a* is not present. Accordingly, the locking pieces 41*b* and 41*c* are placed on both ends in the circumferential direction of the cutout 41*h*.

The end of the barrel 41 at which the locking pieces 41*b* and 41*c* and the engaging piece 41*a* are formed has a large diameter section 41*i*, which has a slightly larger outside diameter, and the outer circumferences of the locking pieces 41*b* and 41*c* and the engaging piece 41*a* are located in a position one step radially inner than the outer circumference of the large diameter section 41*i*. In addition, slits 41*j* are formed in the barrel 41 to extend in the axial direction from the vicinities of the roots of the locking pieces 41*b* and 41*c* on the side of engaging piece 41*a* to thereby expand the elastically-deformable areas of the locking pieces 41*b* and 41*c*.

The barrel 41 is surrounded by the coupling nut 42. Threads 42*a* are formed in an inner surface of the end portion of the coupling nut 42. The coupling nut 42 is movable in the axial direction of the barrel 41 and the O-ring 45 is sandwiched between the barrel 41 and the coupling nut 42. The O-ring 45 is placed and positioned between two annular ridges 41*k*, which project from the outer circumference of the barrel 41, so the O-ring 45 would not be exposed even when the coupling nut 42 moves. An annular groove 41*m* is formed in the outer circumference of the barrel 41, which is located a little behind the annular ridges 41*k*.

On the other hand, a threaded part 43*b* formed in the outer surface in the front of the cylindrical clamp body 43 is screwed into inside of the rear end of the barrel 41. The clamp body 43 has a large diameter section 43*a* adjacent the rear end of the threaded part 43*b*. A cable seal 47 for waterproof between the plug 40 and an optical cable (not shown, see an optical cable 80 in FIGS. 8 and 9) is provided on the inner circumference of the rear end portion of the clamp body 43. The barrel packing 46 is sandwiched in the axial direction between a rear end surface of the barrel 41 and a front end surface of the large diameter section 43*a* of the clamp body 43.

Three or more slits (not shown) are formed at even intervals in the circumferential direction so as to extend in the axial direction from the rear end of the clamp body 43 to allow contraction in diameter thereof. A rear end side of the clamp nut 44 has a taper portion that is tapered toward the rear end and the minimum inner diameter of the taper portion is substantially the same as the outer diameter of an optical cable (not shown) passing through the cable seal 47 and the clamp body 43. Accordingly, when the clamp nut 44 is screwed onto the outer circumference of the rear end side of the clamp body 43, an inner surface of the taper portion of the clamp nut 44 presses the rear end side of the clamp body 43, which is divided by the slits, toward the axial center, thereby reducing the diameter of the rear end portion of the clamp body 43 and clamping the optical cable via the cable seal 47.

Figure 4A:
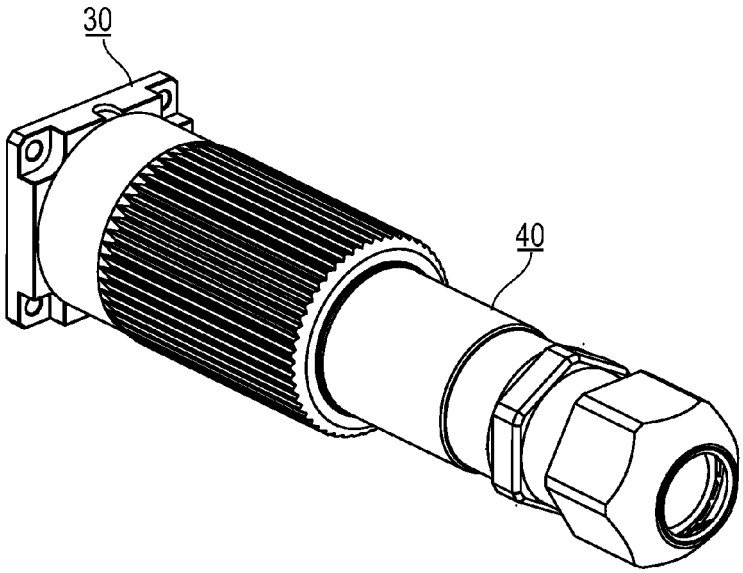
FIG. 4A is a perspective view illustrating a state in which the plug 40 and the receptacle 30 in FIG. 1 have been engaged with and connected.
Figure 4B:
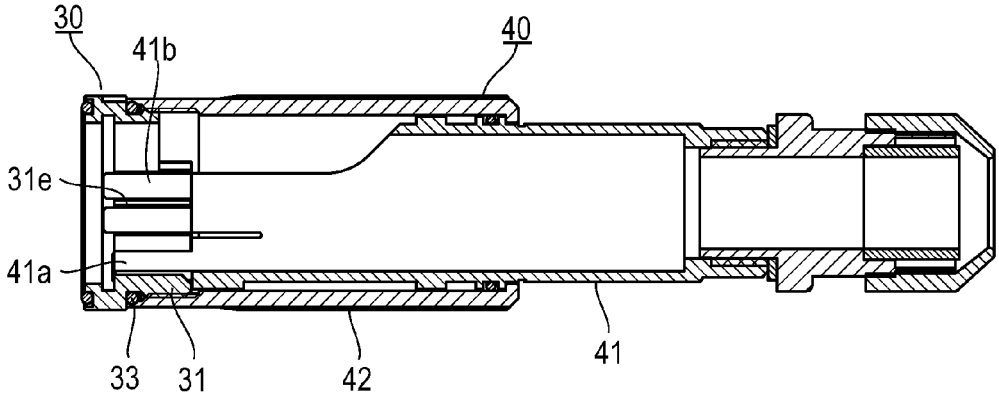
FIG. 4B is a sectional view of a section including the axis of the plug 40 and the receptacle 30 in FIG. 1 that have been connected to each other.

FIG. 4A is a perspective view illustrating a state in which the plug 40 and the receptacle 30 as described above are connected. FIG. 4B is a sectional view of a section including the axis of the plug 40 and the receptacle 30, in which the coupling nut 42 is screwed onto the cylindrical part 31 of the receptacle 30, and the plug 40 and the receptacle 30 are connected to each other. At this time, the O-ring 33 provided on the receptacle 30 is clamped by the coupling nut 42. In addition, the engaging piece 41*a* and the pair of locking pieces 41*b* and 41*c* formed on the barrel 41 of the plug 40 are inserted into and engaged with the cylindrical part 31 of the receptacle 30 and the pair of locking pieces 41*b* and 41*c* are caught in the receptacle 30.

The engaging piece 41*a* and the pair of locking pieces 41*b* and 41*c* are inserted into the cylindrical part 31 of the receptacle 30 until they appear from the end of the coupling nut 42 in a state in which the coupling nut 42 of the plug 40 is retracted with respect to the barrel 41. This enables the plug 40 to be temporarily secured to the receptacle 30. Then, the coupling nut 42 is slid forwardly and screwed onto the receptacle 30.

Figure 5:
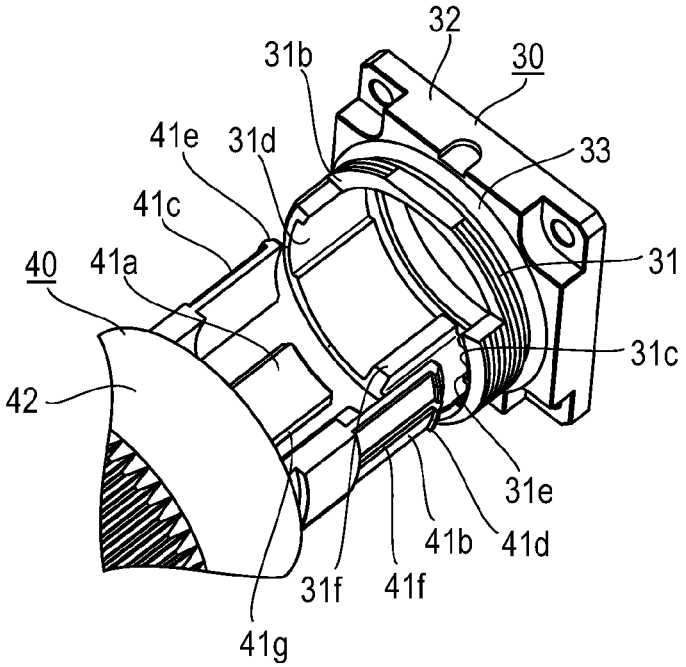
FIG. 5 is a partial enlarged view illustrating a state before the plug and the receptacle are temporarily secured.
Figure 6:
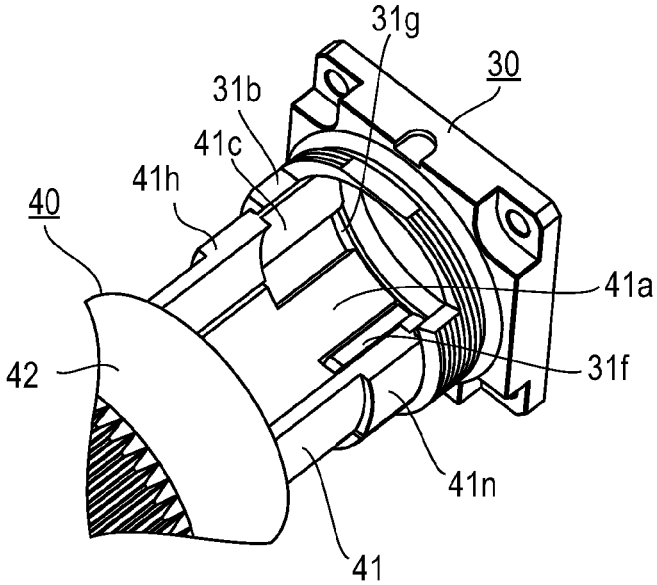
FIG. 6 is a partial enlarged view illustrating a state in which the plug and the receptacle are temporarily secured.

FIG. 5 shows a state before the plug 40 is temporarily secured to the receptacle 30; FIG. 6 shows a state in which the plug 40 has been temporarily secured to the receptacle 30. The coupling nut 42 has been retracted toward the rear end of the barrel 41.

The engaging piece 41*a* and the pair of locking pieces 41*b* and 41*c* are inserted into and engaged with the cylindrical part 31 of the receptacle 30 as shown in FIG. 6. The pair of locking pieces 41*b* and 41*c* are placed and positioned in the recessed sections 31*c* and 31*d*, respectively, which are formed in the inner surface of the cylindrical part 31. At this time, the key 31*e* formed in the recessed section 31*c* is inserted into and engaged with the slit 41*f* formed in the locking piece 41*b*. The locking hooks 41*d* and 41*e* formed on the locking pieces 41*b* and 41*c*, respectively, are caught in the annular groove 31*g* of the receptacle 30 and the locking pieces 41*b* and 41*c* are thereby caught in the receptacle 30.

On the other hand, the key 31*f* formed in the inner surface of the cylindrical part 31 of the receptacle 30 is inserted into and engaged with the slit 41*g* formed in the engaging piece 41*a*, thereby positioning the engaging piece 41*a*.

As described above, in this example, the pair of the locking pieces 41*b* and 41*c* and the engaging piece 41*a* are inserted into and engaged with the cylindrical part 31 of the receptacle 30, the locking piece 41*b* is positioned by a wall of the recessed section 31*c* and the key 31*e*, and the locking piece 41*c* is positioned by a wall of the recessed section 31*d* to restrict their movements. In addition, the locking hooks 41*d* and 41*e* are caught in the annular groove 31*g* of the receptacle 30 so as not to be removed. The engaging piece 41*a* is positioned by the key 31*f* to be restrained in its movement.

This structure significantly increases the strength with which the barrel 41 is locked in the receptacle 30 in this example compared to the prior art and, even if an external force is applied in any direction, the barrel 41 would not come off and the plug 40 can be temporarily secured to the receptacle 30 tightly.

As shown in FIG. 6, the cutout 41*h* of the barrel 41 and the cutout 31*b* of the receptacle 30 are formed so as to be substantially aligned with each other. Accordingly, when the plug 40 is temporarily secured to the receptacle 30, a large opening through which the internal connectors can be seen is formed.

Figure 7:
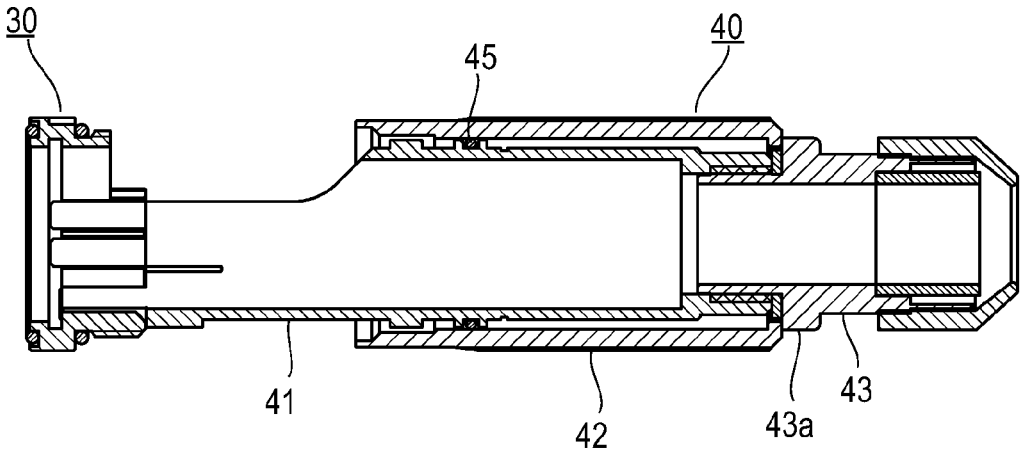
FIG. 7 is a sectional view of a section including the axis in a state in which a coupling nut is retracted with respect to a barrel.

FIG. 7 shows a state in which the coupling nut 42 is retracted with respect to the barrel 41. The rear end of the coupling nut 42 makes engagement with the large diameter section 43*a* of the clamp body 43 as shown in FIG. 7 so that the coupling nut 42 does not come off.

Figure 8:
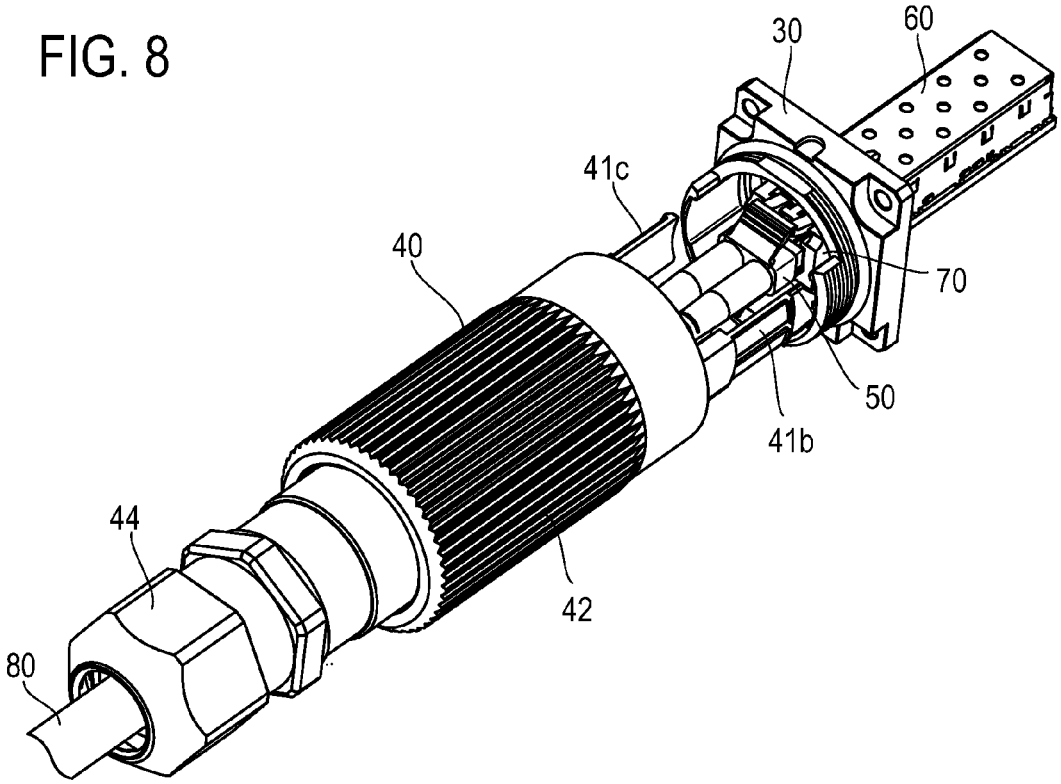
FIG. 8 is a perspective view illustrating a state 1 of connection between the plug and the receptacle that house internal connectors.
Figure 9:
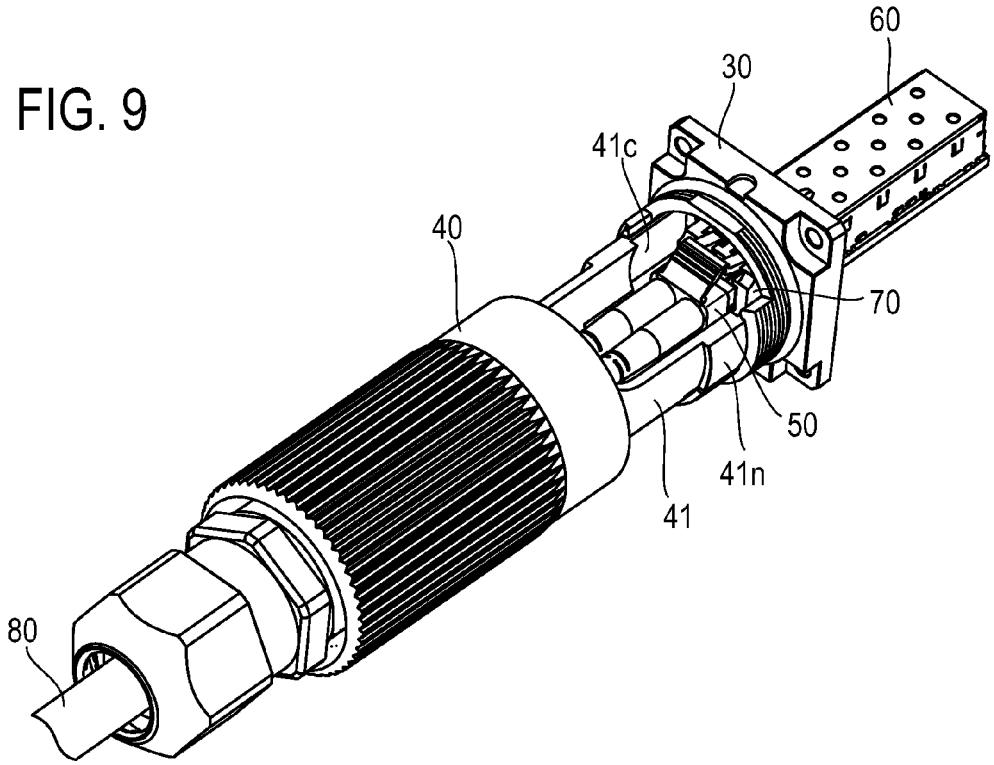
FIG. 9 is a perspective view illustrating a state 2 of connection between the plug and the receptacle that house internal connectors.
Figure 10:
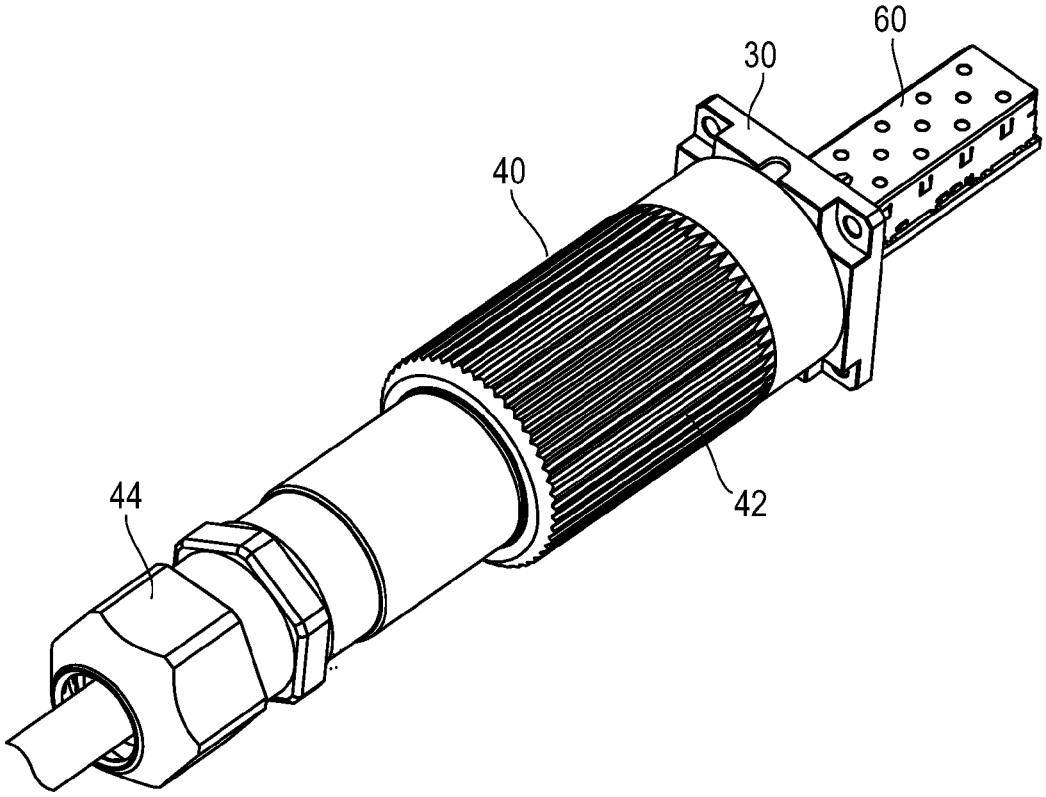
FIG. 10 is a perspective view illustrating a state 3 of connection between the plug and the receptacle that house internal connectors.
Figure 11A:
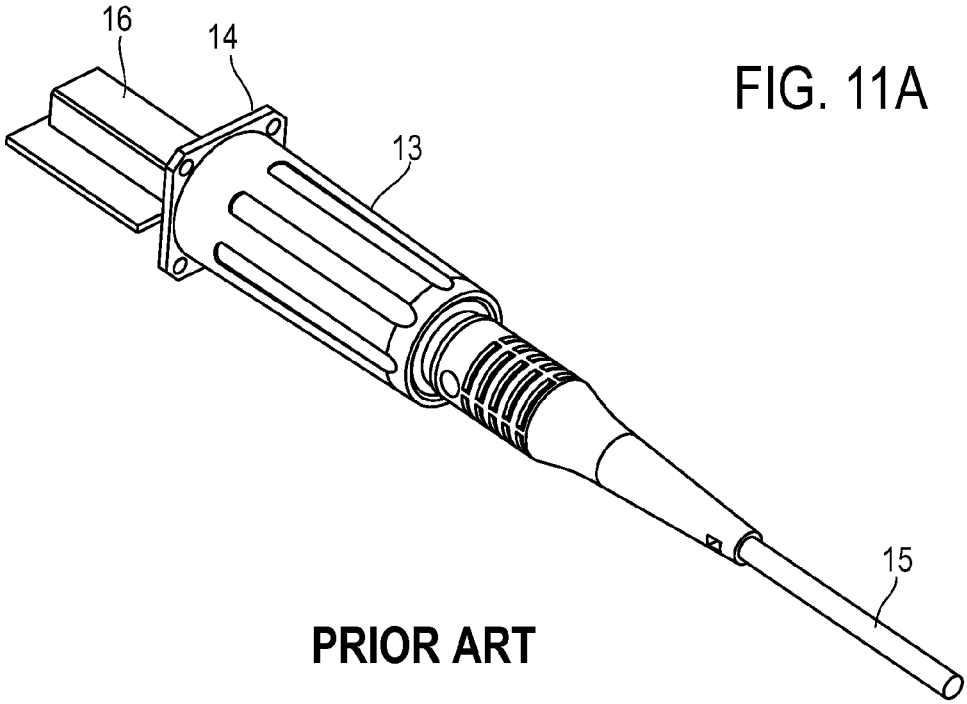
FIG. 11A PRIOR ART
FIG. 11A is a perspective view of a conventional connector.
Figure 11B:
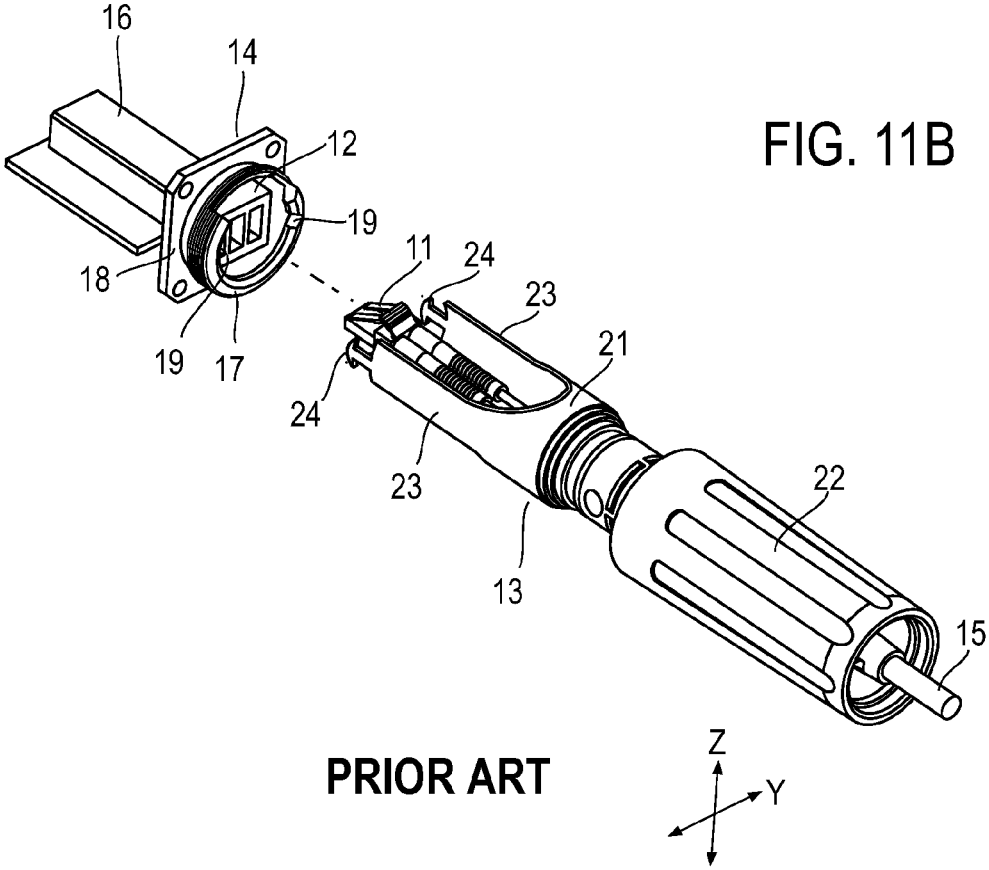
FIG. 11B PRIOR ART
FIG. 11B is a perspective view illustrating a state before the connector in FIG. 11A is connected.

FIGS. 8 to 10 show the procedure for connecting the plug 40 and the receptacle 30 that house the internal connectors. The barrel 41 of the plug 40 houses an optical connector 50 and the receptacle 30 houses an optical connector 70 of a transceiver 60. The plug 40 and the receptacle 30 constitute outer shells for the optical connectors 50 and 70.

The procedure for connecting the plug 40 to the receptacle 30 will be described below.

(1) First, loosen the clamp nut 44. This releases the pressed fixation of the optical cable 80 to make the optical connector 50 movable relative to the plug 40.

(2) Connect the optical connector 50 to the optical connector 70 (FIG. 8).

(3) Insert the locking pieces 41*b* and 41*c* and the engaging piece 41*a* into the receptacle 30 to temporarily secure the plug 40 to the receptacle 30 (FIG. 9).

(4) Screw the coupling nut 42 onto the receptacle 30 to secure the coupling nut 42 (FIG. 10).

(5) Finally, tighten the clamp nut 44 to complete the procedure for connecting the plug 40 to the receptacle 30.

The procedure for disconnecting the plug 40 will be described below.

(1) Loosen the coupling nut 42 and disengage it from the receptacle 30.

(2) Disconnect the optical connector 50 from the optical connector 70.

(3) Pull out the locking pieces 41*b* and 41*c* and the engaging piece 41*a* from the receptacle 30 while pressing, from both sides, the portions (lock release parts 41*n*) of the large diameter section 41*i* at the roots of the locking pieces 41*b* and 41*c*. This disconnects the plug 40 from the receptacle 30 and the procedure of disconnection is completed.

An embodiment of the present invention has been described above. The major points and advantages of the embodiment will be described below.

(a) The engaging piece 41*a* as well as the pair of locking pieces 41*b* and 41*c*, which face each other, are inserted into the receptacle 30 and positioned, and the plug 40 is thereby temporarily secured. This significantly improves the locking strength during temporary fixation, so that the connection or disconnection of the internal connectors and the screwing of the coupling nut 42 are made easy and safe.

(b) The slit 41*f* is provided in the locking piece 41*b* and the key 31*e* to be engaged with the slit 41*f* is provided in the receptacle 30. This prevents the locking pieces 41*b* and 41*c* and the engaging piece 41*a* from being inserted incorrectly.

(c) The recessed sections 31*c* and 31*d* are provided in the inner surface of the cylindrical part 31 of the receptacle 30 and the locking pieces 41*b* and 41*c* are guided by the recessed sections 31*c* and 31*d* and then inserted. Accordingly, the movement of the locking pieces 41*b* and 41*c* can be restrained by the recessed sections 31*c* and 31*d*.

(d) The large cutouts 41*h* and 31*b* are provided in the cylindrical part 31 of the barrel 41 and the receptacle 30 to form a large opening. This facilitates the connection and disconnection of the internal connectors.

(e) The marker 32*c* is provided in the flange 32 of the receptacle 30. This indicates the position of the cutout 31*b* of the cylindrical part 31 and the direction in which the internal connectors can be visually recognized, thereby facilitating, for example, the positioning of the worker who disconnects the internal connectors.

(f) The annular groove 41*m* that is exposed upon completion of the screwing of the coupling nut 42 is provided in the outer circumference of the barrel 41. Accordingly, the completion of the screwing can be determined by a visual check of the annular groove 41*m*.

(g) The screw heads of the screws for securing the flange 32 of the receptacle 30 to a panel etc. are located in the counterbored sections 32*a*. This prevents interference with the coupling nut 42 or injury from the screw heads.

(h) The receptacle 30 includes the O-rings 33 and 34 and the plug 40 includes the O-ring 45, the barrel packing 46, and the cable seal 47. This achieves the water-proof structure of the connector including the plug 40 and the receptacle 30.

In the above embodiment, optical connectors such as standardized LC connectors, SC connectors, etc. are used as the internal connectors. The internal connectors are not limited to such optical connectors and electric connectors may also be used.

What is claimed is:

1. A connector having a plug capable of housing one internal connector as an outer shell and a receptacle capable of housing another internal connector as an outer shell, the plug and the receptacle being connected to each other, the one internal connector and the other internal connector being connected to each other, wherein the receptacle includes a cylindrical part and a flange formed at one end of the cylindrical part, the plug includes a cylindrical barrel that houses the one internal connector and a coupling nut that is disposed on an outer circumference of the barrel and movable along an axial direction of the barrel, an engaging piece and a pair of locking pieces project in the axial direction from an end of the barrel, the pair of locking pieces facing each other in a diameter direction of the barrel, and a pair of locking hooks project outwardly from each other from the respective tips of the pair of locking pieces, the engaging piece and the pair of locking pieces being inserted into and engaged with the cylindrical part by the pair of locking hooks so as to be positioned on an inner surface of the cylindrical part, the pair of locking pieces being secured to the receptacle by the pair of locking hooks so that the plug is temporarily secured to the receptacle, and the plug and receptacle are connected to each other when the coupling nut is screwed onto threads formed on an outer circumference of the cylindrical part.

2. The connector according to claim 1, wherein the pair of locking pieces are placed and positioned in a pair of recessed sections formed in the inner surface of the cylindrical part, the pair of recessed sections facing each other.

3. The connector according to claim 2, wherein a slit is formed in one of the pair of locking pieces and a key to be inserted into and engaged with the slit is formed in one of the pair of recessed sections.

4. The connector according to claim 1, wherein the locking hooks are placed in an annular groove formed in the inner surface of the cylindrical part to lock the pair of locking pieces.

5. The connector according to claim 1, wherein a key projecting from the inner surface of the cylindrical part is inserted into and engaged with a slit formed in the engaging piece to position the engaging piece.

6. The connector according to claim 1, wherein a first cutout is formed at the end of the barrel and a second cutout is formed at the end of the cylindrical part so that the first cutout and the second cutout coincide in position.

7. The connector according to claim 6, wherein a marker indicating the position of the second cutout of the cylindrical part is disposed in the flange.

8. The connector according to claim 6, wherein the first cutout is formed in a circumferential direction of the barrel between the pair of locking pieces on a side on which the engaging piece is not present.

9. The connector according to claim 1, wherein an O-ring is sandwiched between the barrel and the coupling nut.

10. The connector according to claim 1, wherein an O-ring clamped by the coupling nut is placed at a root of the cylindrical part.

* * * * *